US007461797B2

(12) United States Patent
Bhat

(10) Patent No.: US 7,461,797 B2
(45) Date of Patent: Dec. 9, 2008

(54) AIR KNIFE

(75) Inventor: Shrindar Bhat, Bangalore (IN)

(73) Assignee: Spraying Systems, Co., Wheaton, IL (US)

( * ) Notice: Subject to any disclaimer, the term of this patent is extended or adjusted under 35 U.S.C. 154(b) by 393 days.

(21) Appl. No.: 11/270,090

(22) Filed: Nov. 9, 2005

(65) Prior Publication Data

US 2006/0118657 A1 Jun. 8, 2006

Related U.S. Application Data

(60) Provisional application No. 60/626,543, filed on Nov. 10, 2004.

(51) Int. Cl.
*B05B 1/00* (2006.01)

(52) U.S. Cl. ..... 239/597; 239/455; 239/521; 239/566; 239/590.5; 239/594

(58) Field of Classification Search ..... 239/455, 239/518, 521, 522, 548, 550, 566, 589, 590, 239/590.5, 597, 592, 594
See application file for complete search history.

(56) References Cited

U.S. PATENT DOCUMENTS

| | | | | |
|---|---|---|---|---|
| 2,921,748 | A | 1/1960 | Kane | |
| 2,940,418 | A * | 6/1960 | Penrod et al. | 239/597 |
| 3,699,872 | A | 10/1972 | Kruger | |
| 3,741,643 | A | 6/1973 | Smith et al. | |
| 3,750,955 | A | 8/1973 | Nakai et al. | |
| 4,046,492 | A | 9/1977 | Inglis | |
| 4,270,702 | A | 6/1981 | Nicholson | |
| 4,515,313 | A | 5/1985 | Cavanagh | |
| 4,667,882 | A | 5/1987 | Pacifici | |
| 4,887,545 | A | 12/1989 | Soininen | |
| 4,930,705 | A | 6/1990 | Broerman | |
| 5,609,305 | A | 3/1997 | Webb | |
| 6,440,215 | B1 * | 8/2002 | Lymn et al. | 239/597 |

FOREIGN PATENT DOCUMENTS

EP 0 372 902 A1 6/1990

OTHER PUBLICATIONS

International Search Report (Jan. 16, 2007).

* cited by examiner

*Primary Examiner*—Steven J Ganey
(74) *Attorney, Agent, or Firm*—Leydig, Voit & Mayer, Ltd.

(57) ABSTRACT

The present invention provides a fluid discharge apparatus for producing a curtain of air. The apparatus comprises a body member having an air inlet chamber and an air outlet chamber. The air outlet chamber is in fluid communication with the air inlet chamber. The body member defines a discharge orifice through which fluid is discharged from the body member with the discharge orifice being in fluid communication with the air outlet chamber. The air outlet chamber has a pair of opposing sidewalls with each of the sidewalls having an angled sidewall portion. The angled sidewall portions are arranged to converge towards each other as the angled sidewall portions extend in a downstream direction towards the discharge orifice so as to define a generally V-shaped lead-in section that guides and directs fluid towards the discharge orifice. The discharge orifice is defined by first and second edges with the first edge being defined by an extended wall portion that extends downstream past the second edge so as to define a deflection surface for the discharging fluid that extends past the discharge orifice.

10 Claims, 7 Drawing Sheets

AIR KNIFE

CROSS-REFERRENCE TO RELATED APPLICATIONS

This patent application claims the benefit of U.S. Provisional Patent Application No. 60/626,543, filed Nov. 10, 2004.

FIELD OF THE INVENTION

This invention pertains generally to a fluid discharge apparatus, and more particularly to an apparatus for producing an air curtain.

BACKGROUND OF THE INVENTION

Devices that produce a curtain of air such as air knives are used in a variety of different applications for cleaning and drying purposes. For example, an air knife can be used to blow dirt and other debris off objects such as parts, sheets or webs including conveyors. An air knife can also be used to help cool or dry such objects.

To optimize performance, the air curtain preferably forms a knife-edge as it hits the objects being cleaned or dried. This maximizes the force per unit area produced by the air curtain. The velocity of the discharging air and the thickness of the air curtain are two key factors involved in producing a good knife-edge.

Unfortunately, many existing air knives produce air curtains that have a great deal of turbulence. This turbulence reduces the velocity of the air curtain and also can cause the air to fan out as it exits the air knife leading to a relatively wider air curtain. The decreased velocity and increased width reduce the impact of the air curtain adversely affecting the performance and effectiveness of the air knife.

BRIEF SUMMARY OF THE INVENTION

The present invention provides a fluid discharge apparatus for producing a curtain of air. The apparatus comprises a body member having an air inlet chamber and an air outlet chamber. The air outlet chamber is in fluid communication with the air inlet chamber. The body member defines a discharge orifice through which fluid is discharged from the body member with the discharge orifice being in fluid communication with the air outlet chamber. The air outlet chamber has a pair of opposing sidewalls with each of the sidewalls having an angled sidewall portion. The angled sidewall portions are arranged to converge towards each other as the angled sidewall portions extend in a downstream direction towards the discharge orifice so as to define a generally V-shaped lead-in section that guides and directs fluid towards the discharge orifice. The discharge orifice is defined by first and second edges with the first edge being defined by an extended wall portion that extends downstream past the second edge so as to define a deflection surface for the discharging fluid that extends past the discharge orifice.

DETAILED DESCRIPTION OF THE INVENTION

Figure 1:
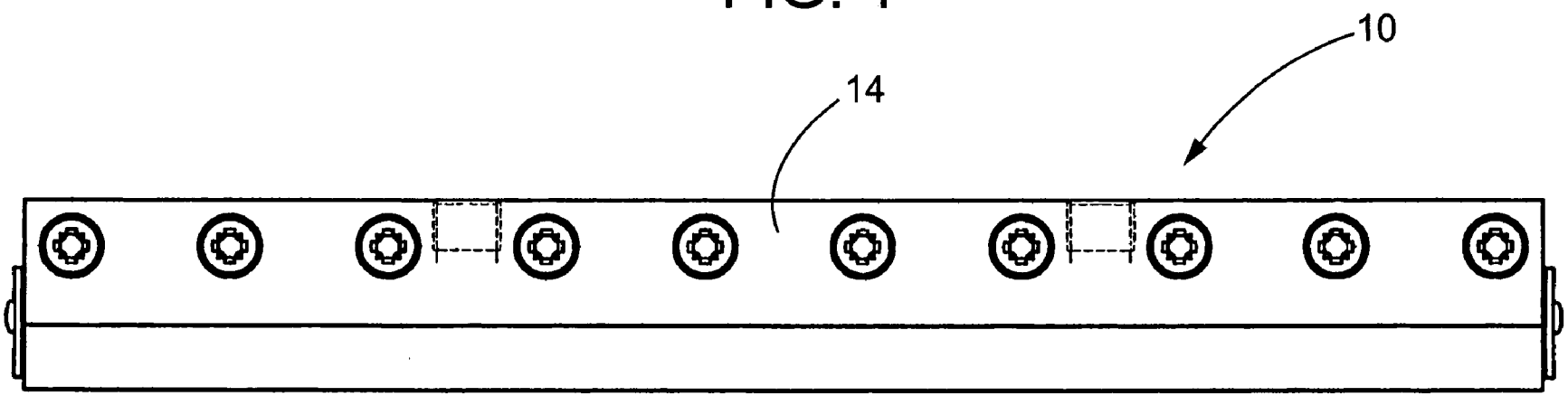
FIG. 1 is a top view of an illustrative air knife constructed in accordance with the present invention.
Figure 2:
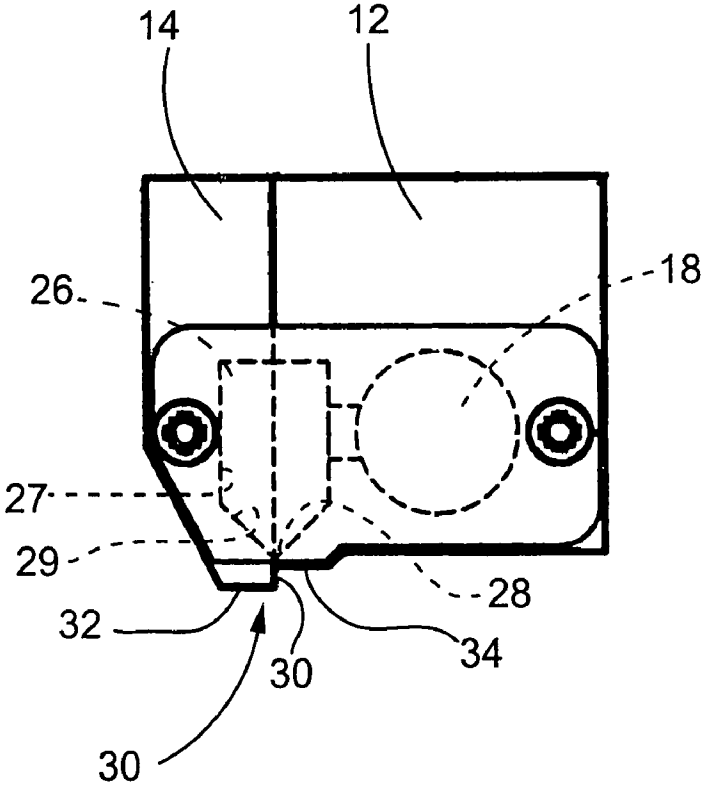
FIG. 2 is a side view of the air knife of FIG. 1.

Referring now more particularly to the drawings, FIGS. 1 and 2 illustrate an exemplary air knife 10 constructed in accordance with the present invention. The illustrated air knife 10 produces a thin curtain of air that can be used, for example, to clean, cool or dry objects. The air knife 10 can also be used in other applications and the present invention should not be limited to any particular application. In addition, while the present invention is described in connection with producing an air curtain, it will be understood that the air knife of the present invention can be used to discharge other fluids as well.

Figure 4:
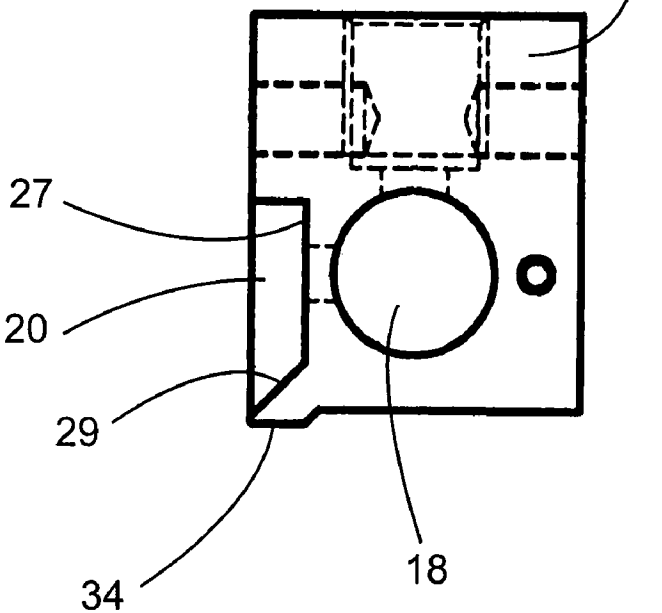
FIG. 4 is a side view of the base portion of the air knife of FIG. 1.
Figure 3:
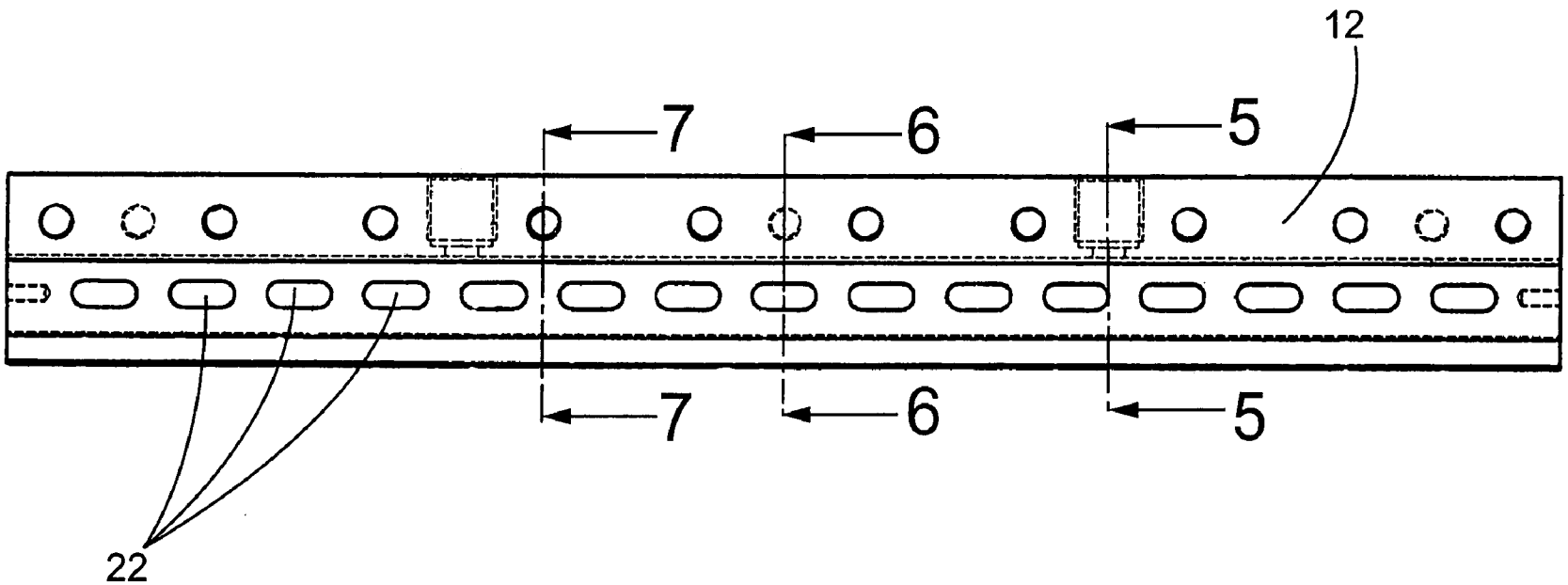
FIG. 3 is a front view of the base portion of the air knife of FIG. 1.
Figure 6:
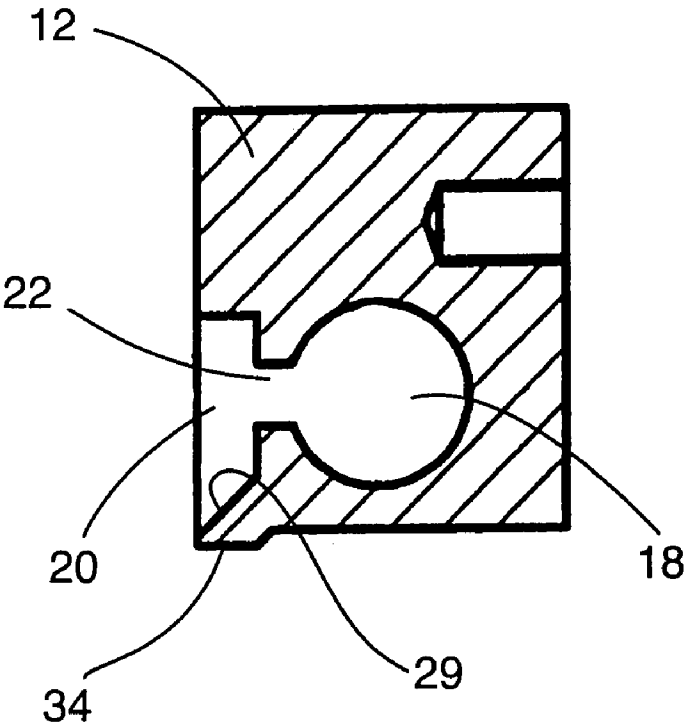
FIG. 6 is a side sectional view of the base portion of the air knife of FIG. 1 taken in the plane of line 6-6 in FIG. 3.
Figure 5:
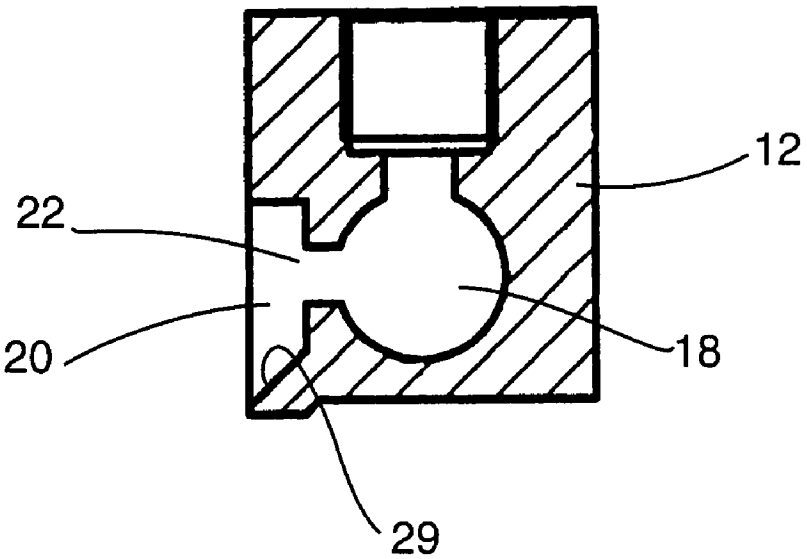
FIG. 5 is a side sectional view of the base portion of the air knife of FIG. 1 taken in the plane of line 5-5 in FIG. 3.
Figure 7:
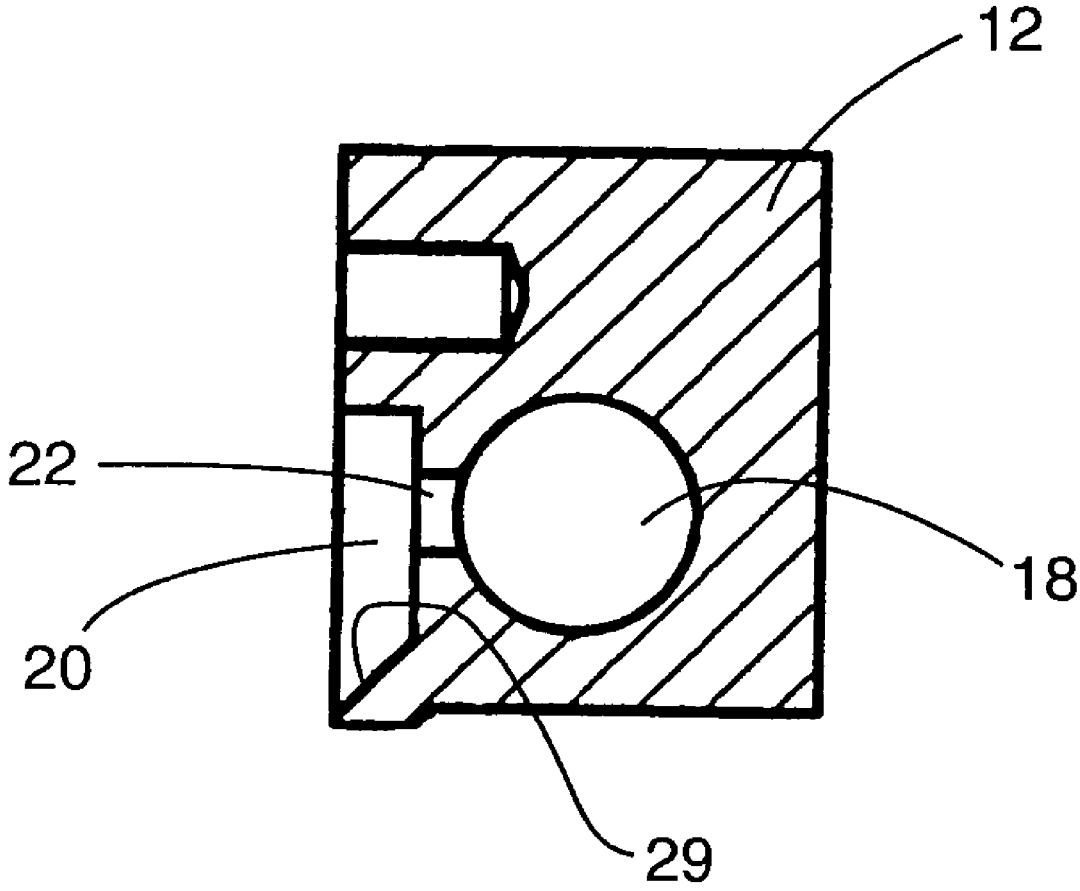
FIG. 7 is a side sectional view of the base portion of the air knife of FIG. 1 taken in the plane of line 7-7 in FIG. 3.

In the illustrated embodiment, the air knife 10 generally includes a base portion 12, a blade portion 14 and an intermediate shim (not shown). The base and blade portions 12, 14 can be made of any suitable material that can be machined or formed in the desired shape such as, for example, stainless steel or aluminum. As best shown in FIGS. 4-6, the base portion 12 includes an elongate cylindrical bore that defines a first air inlet chamber 18. The base portion 12 further includes a first channel 20, which is formed in an inner mating face of the base portion. A plurality of longitudinally spaced slots 22 (see FIG. 3) extend between the air inlet chamber 18 and the channel 20 so as to define multiple passageways communicating between the air inlet chamber and the channel.

Figure 8:
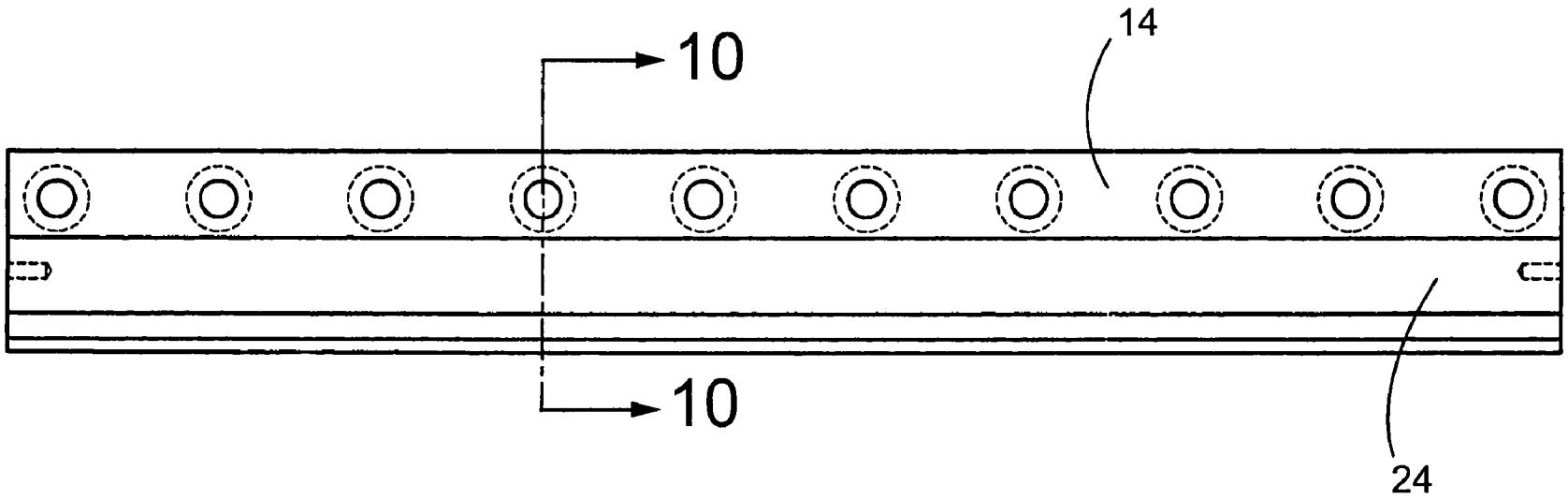
FIG. 8 is rear view of the blade portion of the air knife of FIG. 1.
Figure 10:
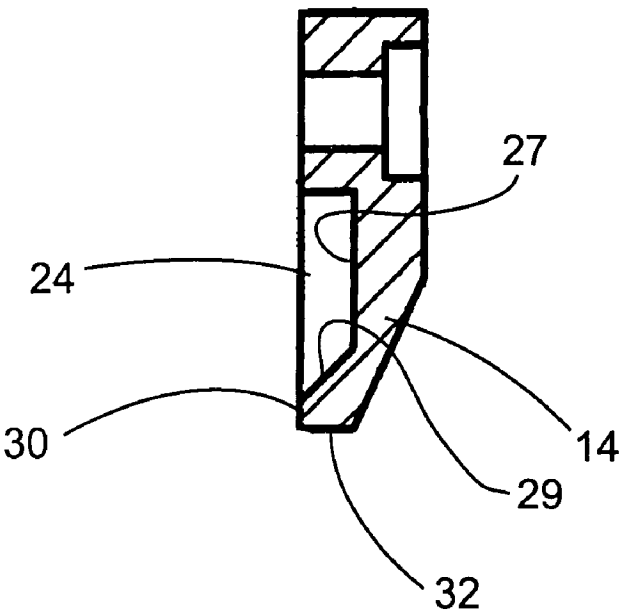
FIG. 10 is a side sectional view of the blade portion of the air knife of FIG. 1 taken in the plane of line 10-10 in FIG. 8.
Figure 9:
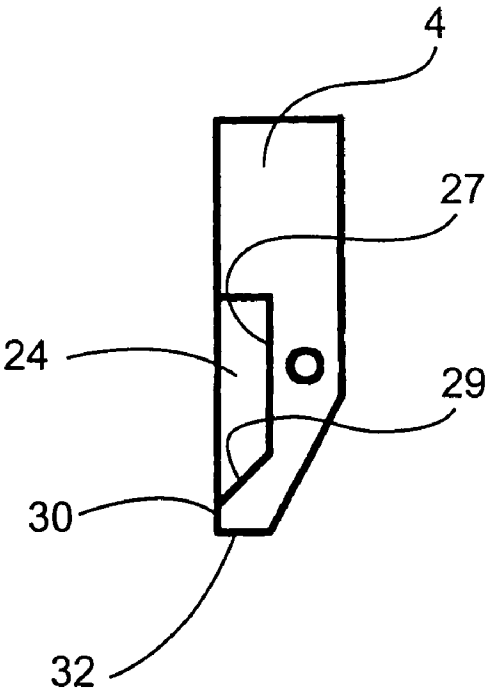
FIG. 9 is a side view of the blade portion of the air knife of FIG. 1.

As shown in FIGS. 8-10, a corresponding second channel 24 is formed in an inside mating face of the blade portion 14. When the base and blade portions 12, 14 are assembled together as shown in FIG. 2, the channels 20, 24 in the faces of the two portions align so as to define an air outlet chamber 26. The air outlet chamber 26 communicates with an elongate discharge orifice 28 through which air is discharged from the air knife. The discharge orifice 28 of the air knife is defined by outer edges of the base and blade portions 12, 14, which are spaced apart by virtue of the shim arranged between the blade and base portions.

In accordance with one important aspect of the present invention, the air outlet chamber 26 and the discharge orifice 28 are configured so as to minimize the amount of turbulence in the air discharging through the discharge orifice. This ensures that the curtain formed by the discharging air forms a knife-edge that produces an optimal force per unit area. To this end, as best shown in FIG. 2, the sidewalls 27 of the air outlet chamber 26 angle towards each other as they extend towards the discharge orifice 28. In particular, each of the sidewalls 27 of the air outlet chamber 26 has an angled portion 29 at the end of the respective sidewall closest the discharge orifice 28. Each of the angled portions 29 has a planar configuration and the two angled portions 29 converge with each other as they extend towards the discharge orifice 28 such that the angled portions form a V-shaped lead-in section that guides and directs the air towards the discharge orifice 28. In the illustrated embodiment, the angled portion 29 of each of the sidewalls 27 extends at an angle of approximately 45° relative to the remainder of the respective sidewall. The angled portions 29 of the sidewalls 27 preferably extend at an angle of between approximately 40° and approximately 50°.

To further smooth and direct the flow of discharging air thereby reducing turbulence, the outer edge of the blade portion 14 includes an extended flat portion 30 that continues downstream from the angled lead-in portion 29 of the outlet chamber 26 defined by the blade portion as shown in FIG. 2. The extended flat portion 30 extends beyond the relatively sharper outer edge of the base portion 12 at the downstream end of the angled lead-in portion 29 of the outlet chamber 26 defined by the base portion 12. Thus, the extended flat portion 30 overhangs or extends past the discharge orifice 28 and defines a deflection surface for the discharging air. More specifically, as air is discharged through the discharge orifice 28, the extended flat portion 30 deflects the discharging air and directs it into a sharper, more uniform curtain. Because of this extended flat portion 30 on the blade portion 12, when the base, blade and shim portions 12, 14, 16 are assembled together, the outer surface 32 of the blade portion 14 extends beyond the outer surface 34 of the base portion 12. Thus, the front face 36 of the assembly has an uneven configuration as shown in FIG. 2. According to one preferred embodiment of the present invention, the length of the extended flat portion 30 is approximately 0.2126 cm.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A fluid discharge apparatus for producing a curtain of air comprising a body member having an air inlet chamber and an air outlet chamber, the air outlet chamber being in fluid communication with the air inlet chamber, the body member defining a discharge orifice through which fluid is discharged from the body member, the discharge orifice being in fluid communication with the air outlet chamber, said air outlet chamber has a pair of opposing sidewalls, each of the sidewalls having an angled sidewall portion, said angled sidewall portions being arranged to converge towards each other as the angled sidewall portions extend in a downstream direction towards the discharge orifice so as to define a generally V-shaped lead-in section that guides and directs fluid towards the discharge orifice, said body member including a base portion and a blade portion having parallel mating surfaces that are secured in adjacent relation to each other, said discharge orifice being defined by respective outer edges of said base and blade portions, and one of said outer edges being defined by an extended wall that extends downstream past the other outer edge so as to define a deflection surface for the discharging fluid that extends along one side of the discharge orifice.

2. The fluid discharge apparatus according to claim 1 wherein a shim member is arranged between the base portion and the blade portion.

3. The fluid discharge apparatus according to claim 1 wherein a plurality of longitudinally spaced slots provide the fluid communication between the air inlet chamber and the air outlet chamber.

4. The fluid discharge apparatus according to claim 1 wherein each of the angled sidewall portions has a planar configuration.

5. The fluid discharge apparatus according to claim 1 wherein each of the angled sidewall portions extends at an angle of between approximately 40° and approximately 50° relative to a remaining portion of the respective sidewall.

6. The fluid discharge apparatus according to claim 5 wherein each of the angled sidewall portions extends at an angle of between approximately 45° relative to a remaining portion of the respective sidewall.

7. The fluid discharge apparatus according to claim 1 wherein the extended wall portion extends past the second edge a distance greater than 0.2 cm.

8. The fluid discharge apparatus according to claim 1 in which said deflection surface is in a plane parallel to the mating surfaces of said base and blade portions.

9. The fluid discharge apparatus according to claim 1 in which said extended wall and deflection surface are defined by said blade portion.

10. A fluid discharge apparatus for producing a curtain of air comprising a body member having an air inlet chamber and an air outlet chamber, the air outlet chamber being in fluid communication with the air inlet chamber, the body member defining a discharge orifice through which fluid is discharged from the body member, the discharge orifice being in fluid communication with the air outlet chamber, said air outlet chamber having a pair of opposing sidewalls, each of the sidewalls having an angled sidewall portion, said angled sidewall portions being arranged to converge towards each other as the angled sidewall portions extend in a downstream direction towards the discharge orifice so as to define a generally V-shaped lead-in section that guides and directs fluid towards the discharge orifice, said discharge orifice being defined by first and second edges, said first edge being defined by an extended wall portion that extends downstream past the second edge so as to define a deflection surface for the discharging fluid that extends along one side of the discharge orifice, said body member including a base portion and a blade portion that are secured together, and said air inlet chamber being arranged in said base portion and said air outlet chamber being defined by a first channel in the base portion and a second channel in the blade portion.

* * * * *